US006170577B1

(12) United States Patent
Noles, Jr. et al.

(10) Patent No.: US 6,170,577 B1
(45) Date of Patent: Jan. 9, 2001

(54) CONDUIT CLEANING SYSTEM AND METHOD

(75) Inventors: Jerry W. Noles, Jr., Spring; Leslie Dale Skinner, Houston; Larry George Kuhlman, Columbus, all of TX (US)

(73) Assignee: Advanced Coiled Tubing, Inc., Houston, TX (US)

( * ) Notice: Under 35 U.S.C. 154(b), the term of this patent shall be extended for 0 days.

(21) Appl. No.: 09/020,100

(22) Filed: Feb. 6, 1998

Related U.S. Application Data

(60) Provisional application No. 60/037,321, filed on Feb. 7, 1997.

(51) Int. Cl.[7] ..... E21B 37/00

(52) U.S. Cl. ..... 166/312; 166/222; 134/22.12

(58) Field of Search ..... 166/312, 222, 166/223; 134/22.12, 22.11

(56) References Cited

U.S. PATENT DOCUMENTS

| | | | | |
|---|---|---|---|---|
| 3,116,793 | | 1/1964 | McStravick | 166/21 |
| 3,583,489 | | 6/1971 | Hutchison et al. | 166/312 |
| 3,958,641 | * | 5/1976 | Dill et al. | 166/312 |
| 4,030,548 | | 6/1977 | Richardson et al. | 166/279 |
| 4,067,240 | * | 1/1978 | Straub | 72/377 |
| 4,349,073 | | 9/1982 | Zublin | 166/312 |
| 4,441,557 | * | 4/1984 | Zublin | 166/312 |
| 4,442,899 | | 4/1984 | Zublin | 166/312 |
| 4,518,041 | | 5/1985 | Zublin | 166/312 |
| 4,640,362 | * | 2/1987 | Schellstede | 166/298 |
| 4,781,250 | | 11/1988 | McCormick et al. | 166/240 |
| 5,060,725 | | 10/1991 | Buell | 166/222 |
| 5,183,112 | | 2/1993 | Paul et al. | 166/312 |
| 5,314,545 | * | 5/1994 | Folts et al. | 134/22.11 |
| 5,375,378 | * | 12/1994 | Rooney | 451/38 |
| 5,531,634 | * | 7/1996 | Schott | 451/39 |
| 5,674,616 | * | 10/1997 | Balcar | 428/402 |

* cited by examiner

*Primary Examiner*—Hoang Dang
(74) *Attorney, Agent, or Firm*—E. Randall Smith

(57) ABSTRACT

A system capable of removing scale deposits from an interior metallic surface of a conduit includes a mixture including a plurality of substantially spherically shaped solid particles and fluid, a mixture delivery tubing insertable into the conduit, and a nozzle attached to the mixture delivery tubing. The nozzle includes a plurality of nozzle jets and is capable of ejecting the mixture to loosen scale deposits from the interior metallic surface of the conduit.

38 Claims, 7 Drawing Sheets

FIG. 6
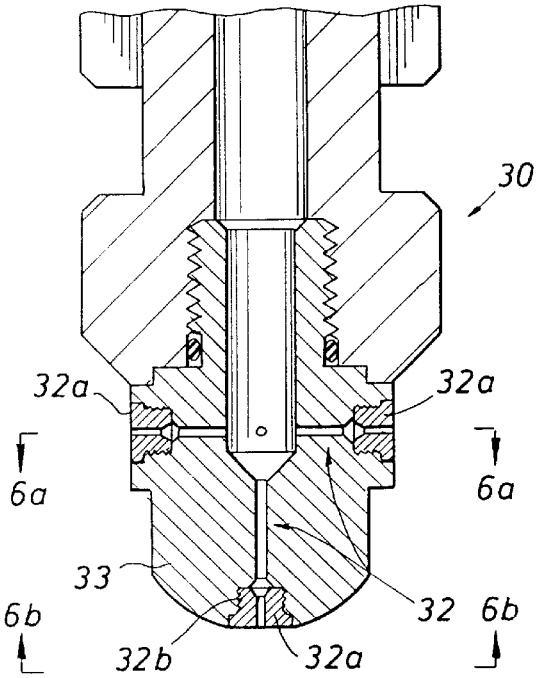
FIG. 5
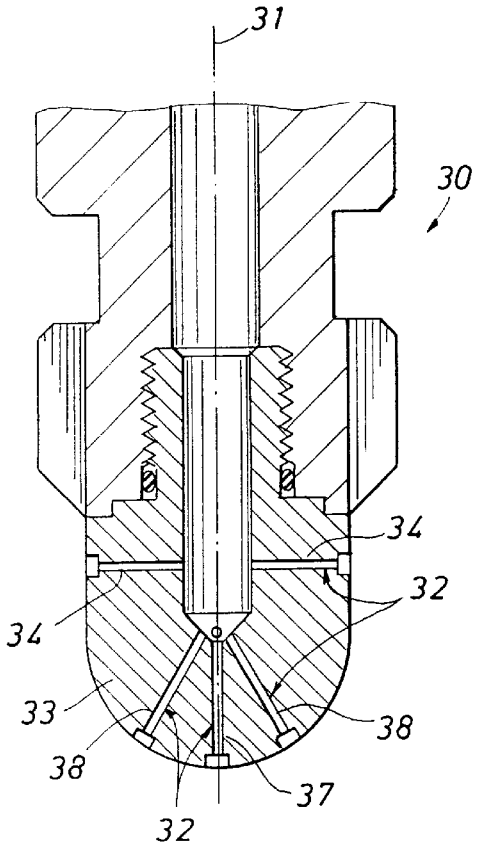
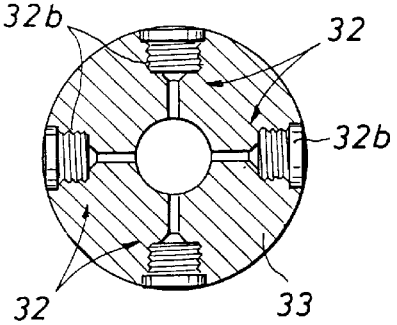
FIG. 6a
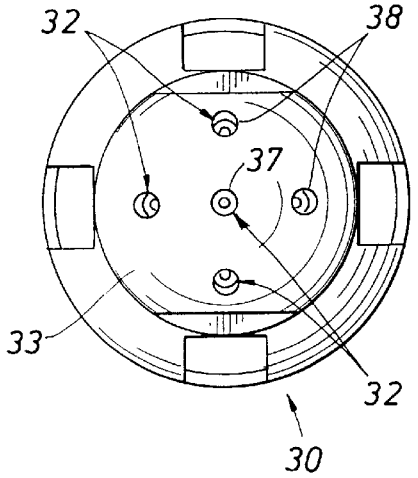
FIG. 5a
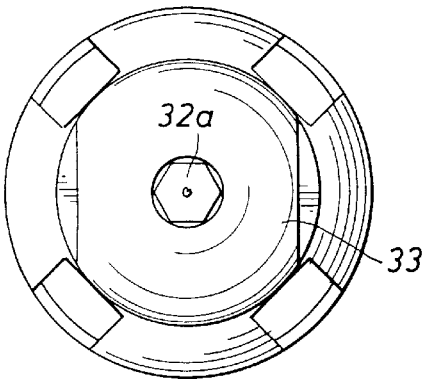
FIG. 6b FIG. 8
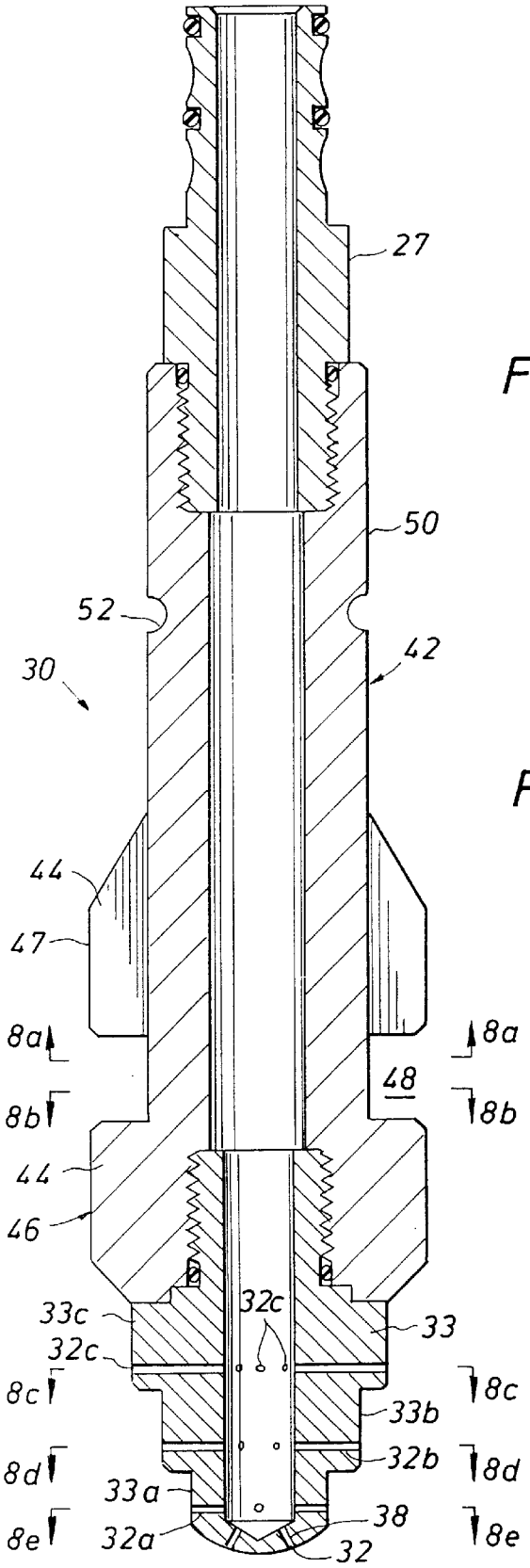
FIG. 8a
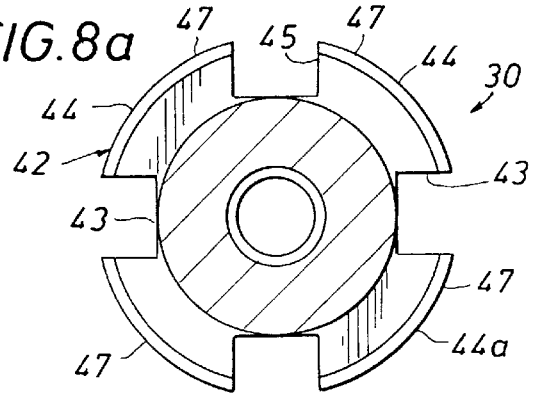
FIG. 8b
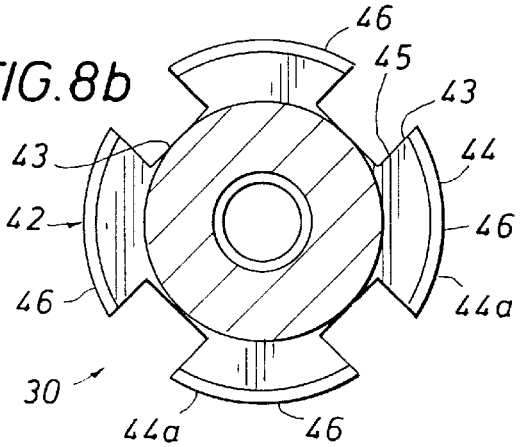
FIG. 8c
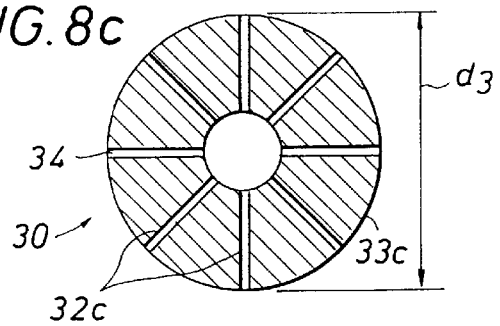
FIG. 8d
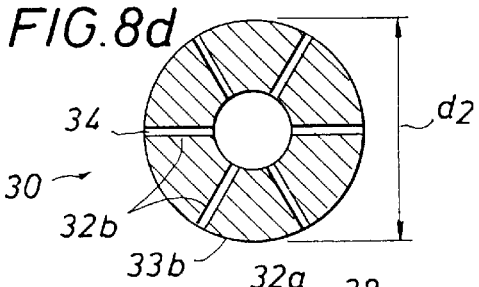
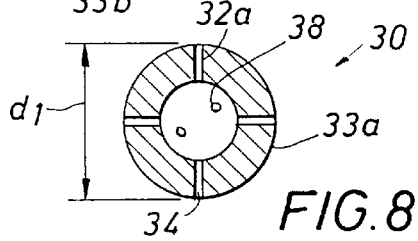
FIG. 8e FIG. 11
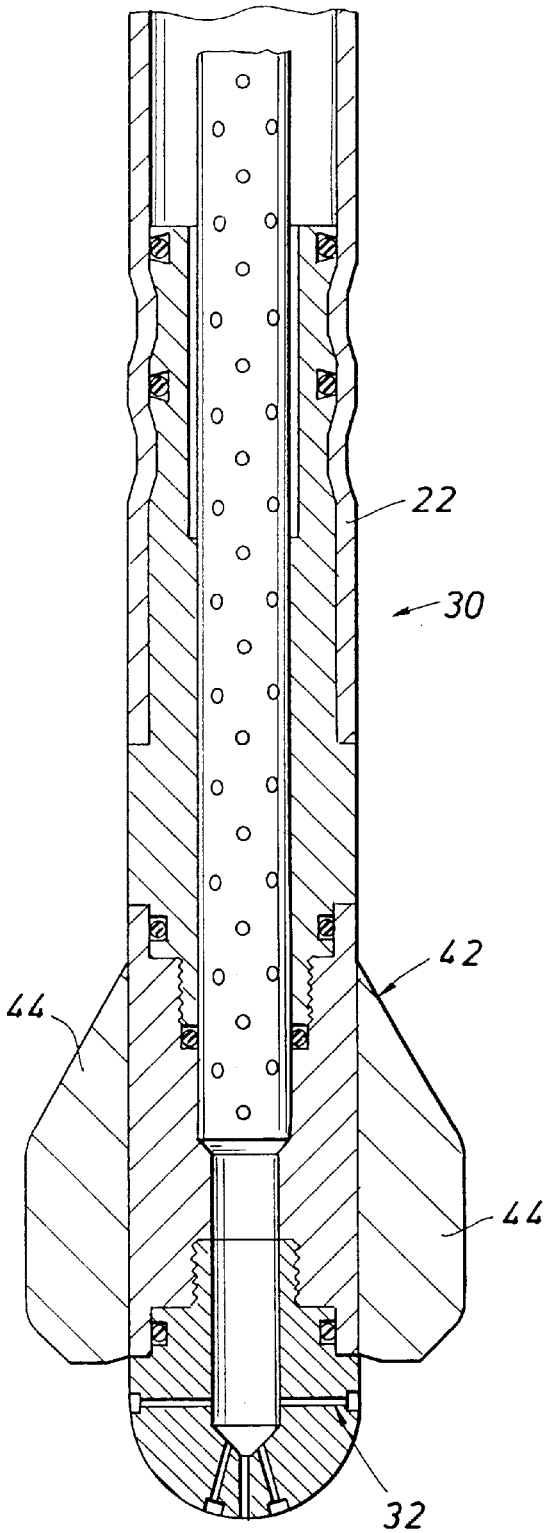
FIG. 9
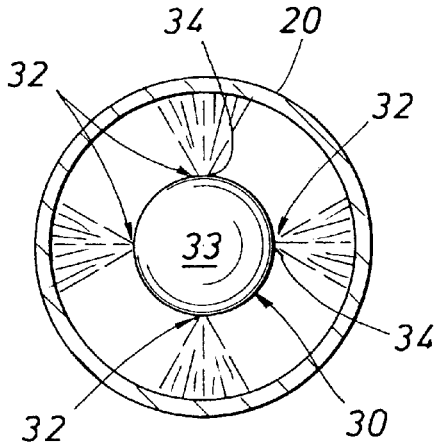
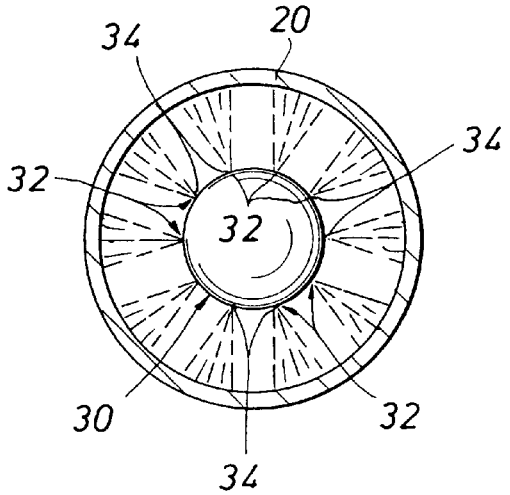
FIG. 10

CONDUIT CLEANING SYSTEM AND METHOD

CROSS REFERENCE TO RELATED APPLICATIONS

The present application claims the benefit of U.S. Provisional application Ser. No. 60/037,321, filed Feb. 7, 1997, entitled Conduit Cleaning System and Method, which is incorporated herein by reference.

STATEMENT REGARDING FEDERALLY SPONSORED RESEARCH AND DEVELOPMENT

Not applicable.

BACKGROUND OF THE INVENTION

The invention relates generally to the field of apparatus and methods used for removing material from inside a conduit. More particularly, the present invention relates to a system capable of loosening and removing material built-up on the inside surface of, or disposed within, a metal conduit.

Undesirable materials that build-up on the inside walls of conduits, such as well tubing, injection lines, pipelines, flowlines, boiler tubes, heat exchangers and water lines, or that otherwise collect inside the conduits, are known to restrict or interfere with the desired movement of fluids, materials and devices, tools, liquids and gases through the conduits. As a result, in many cases, the conduit becomes useless, or inoperable for its intended purpose. For example, thousands of petroleum wells in this country have been shut down or abandoned due to the crippling effect on operations of obstructions in the well tubing. Examples of such undesirable, or obstructive, materials include barium sulfate, strontium sulfate, calcium sulfate, calcium carbonate, iron sulfide, other scale precipitates (such as silicates, sulfates, sulfides, fluorides, carbonates), cement, corrosion products, deteriorated conduit lining, and dehydrated material (such as drilling fluid).

Existing methods of removing obstructive materials from conduits have numerous disadvantages. Various techniques involve the use of a mill or bit to remove obstructive material from conduits. In many applications, the mills or bits have a short useful life due to damage from contact between the mills and bits and commonly occurring hard, dense obstructive materials. The mills or bits must therefore be frequently removed from the conduit and replaced, consuming time and expense. Further, rotation of the mill or bit requires additional component parts, such as a motor, bearings and rotary seals, which are complex and costly to manufacture and operate and subject to failure. Rotary seals typically limit the use or effectiveness of the system due to their vulnerability to wear or damage from high temperatures.

These techniques are also largely ineffective at loosening and removing substantially all obstructive material without damaging the conduit. For example, the inside walls of conduits cleaned with mills or bits are highly subject to damage from contact by the mill or bit. Such contact commonly occurs when the obstructions in the conduit are unevenly dispersed, causing the mill or bit to jam or rub against, or drill into, the side of the conduit. Further, reactive torque due to the rotation of the drill or mill can also cause it to contact the inside surface of the conduit and cause damage thereto. Such reactive torque also accelerates deterioration to the tubing, such as coiled tubing, that carries the mill or bit.

Other conventional cleaning methods utilize jet nozzles that eject only liquid or angular-shaped solid particles in a foam or liquid transport medium. Typical liquid-only systems insertable in a conduit of significant length, such as petroleum tubing and pipelines, operate in low to moderate pressure ranges. These systems have proven ineffective at loosening or removing commonly encountered hard, tightly bonded obstructive materials, such as barium sulfate. The jet systems using angular-shaped solids typically damage the inside surface of metal conduits as a result of the angular solids cutting, scarring and eroding the metal. These systems lack the ability to minimize or control the amount of damage that occurs to the metal conduit; therefore, their use is not entirely satisfactory for many applications. Further, the angular solids provide an erratic erosion pattern, limiting their effectiveness in loosening and removing obstructions.

Thus, there remains a need for a system for loosening and removing undesirable materials built-up on the inside surface of metal conduits, or that otherwise collect inside the conduits, that does not cause substantial or undesirable damage to the conduit. Preferably, the system will be simple, and cost effective and easy to manufacture and operate. Ideally, the system could utilize existing equipment. Especially well received would be a system that can quickly remove all, or substantially all, of the undesirable materials. Ideally, the system would not need to be rotated and would have static seals unaffected by high temperatures. Further, it would be beneficial for the system to be capable of recirculating or reusing its cleaning mixture or the constituents of the cleaning mixture.

BRIEF SUMMARY OF THE INVENTION

In accordance with the present invention, there is provided a system for removing obstructive material from inside a conduit that includes a mixture including a plurality of substantially spherically shaped solid abrasive particles and fluid, a mixture delivery tubing insertable into the conduit and a nozzle assembly attached to the mixture delivery tubing. The nozzle assembly includes a plurality of nozzle jets capable of ejecting the mixture to loosen obstructive material inside the conduit.

The substantially spherically shaped solid abrasive particles may be constructed at least partially of glass, metal, plastic, ceramic, epoxy, other suitable material, or a combination thereof, and may have any suitable size, such as between about 20 mesh and about 100 mesh. Further, the particulate density of the substantially spherically shaped solid abrasive particles may be greater or less than the density of the fluid.

In preferred embodiments, the nozzle assembly is capable of ejecting the mixture to loosen obstructive material inside the conduit without substantially damaging the conduit, and ejecting the mixture around the inner circumference of the conduit without rotating the nozzle assembly.

The system may include a filter capable of preventing clogging of the nozzle jets by particles carried in the mixture. The system may include a mixer capable of mixing the substantially spherically shaped solid abrasive particles and the fluid to form the mixture, and a pump capable of pumping the mixture under pressure into the mixture delivery tubing.

In another aspect of the invention, there is provided a nozzle assembly for ejecting a mixture that includes substantially spherically shaped solid abrasive particles and fluid, the nozzle assembly having a central axis and being associated with a mixture delivery tubing. The nozzle assembly includes a connector member connectable with the mixture delivery tubing, a nozzle head member having a plurality of nozzle jets, at least two of the nozzle jets disposed at angles of between approximately 80 degrees and approximately 100 degrees relative to the central axis of the nozzle assembly, and a gauge ring member disposed between the connector member and the nozzle head member.

In alternate embodiments, the nozzle assembly includes a plurality of nozzle jet inserts matable with a plurality of recesses in the nozzle head member. In alternate embodiments, at least one of the nozzle jets is disposed in the nozzle assembly at an angle of approximately 0 degrees relative to the central axis of the nozzle assembly. At least one of the nozzle jets may be disposed in the nozzle assembly at an angle of between approximately 0 degrees and approximately 90 degrees relative to the central axis of the nozzle assembly, or at least two of the nozzle jets may be disposed in the nozzle assembly at angles of between approximately 10 degrees and approximately 20 degrees relative to the central axis of the nozzle assembly. The nozzle assembly may include a plurality of nozzle assembly sections, each nozzle assembly section having a diameter different than the diameter of adjacent nozzle assembly sections and wherein at least one nozzle jet is disposed in each nozzle assembly section.

The gauge ring may include at least one wide portion and at least one external fluid flow passageway, the wide portion (s) and external fluid flow passageway(s) disposed between the nozzle jets and the mixture delivery tubing. The gauge ring may include a plurality of wide portions, each wide portion having an outer bearing surface, the plurality of outer bearing surfaces extending around the circumference of the nozzle assembly. One or more wide portions may be located proximate to at least two of the nozzle jets. The gauge ring may include first and second sets of wide portions, the second set of wide portions disposed between the first set of wide portions and the plurality of nozzle jets and being at least partially offset on the circumference of the nozzle assembly relative to the first set of wide portions.

The nozzle assembly may be disposed in a conduit and include a fishing tool connection portion, wherein the fishing tool connection portion is capable of being engaged by a fishing tool latch mechanism. Further, the fishing tool connection portion may include a recess capable of receiving a fishing tool latching mechanism. The nozzle assembly may include a filter capable of preventing clogging of the nozzle jets from particles carried in the mixture, and the filter may be disposed at least partially in the mixture delivery tubing.

In yet another aspect of the invention, there is provided a system for separating substantially spherically shaped solid abrasive particles having a known approximate particulate size from a composite effluent that includes fluid, obstructive particles from a conduit and the substantially spherically shaped abrasive particles, the substantially spherically shaped solid abrasive particles having a particulate density that is generally less than the density of the obstructive particles. The system includes a size-differentiating particle separator capable of removing from the composite effluent obstructive particles that are larger in particulate size than the substantially spherically shaped solid abrasive particles, a first density-differentiating particle separator capable of removing from the composite effluent obstructive particles having a density greater than the density of the substantially spherically shaped solid abrasive particles, and a second density-differentiating particle separator capable of separating substantially spherically shaped solid abrasive particles from the fluid. This system may also include a gas separator; a slurry pump capable of pumping substantially spherically shaped solid abrasive particles, an in-line mixer and a fluid pump, the fluid and slurry pumps in fluid communication with the in-line mixer; and a hopper/jet mixer.

In another embodiment of the system for separating substantially spherically shaped solid abrasive particles, the substantially spherically shaped solid abrasive particles have a particulate density that is generally greater than the density of the obstructive particles and the fluid. This embodiment includes a size-differentiating particle separator capable of removing from the composite effluent obstructive particles that are larger in particulate size than the substantially spherically shaped solid abrasive particles, and a density-differentiating particle separator capable of removing substantially spherically shaped solid abrasive particles from the composite effluent. This embodiment may also include a gas separator and a second density-differentiating particle separator capable of separating obstructive particles from the fluid.

In still another embodiment of the system for separating substantially spherically shaped solid abrasive particles, the spherical solids are constructed at least partially of ferromagnetic metal, the system including a size-differentiating particle separator capable of removing from the composite effluent obstructive particles that are larger in particulate size than the substantially spherically shaped solid abrasive particles, and a magnetic separator capable of removing, from the composite effluent, substantially spherically shaped solid abrasive particles constructed at least partially of ferromagnetic metal. This system may also include a gas separator and a second density-differentiating particle separator capable of separating obstructive particles from the fluid.

In another aspect of the invention, there is provided a method of removing obstructive material from inside a conduit including forming a mixture including fluid and substantially spherically shaped solid abrasive particles, supplying the mixture under pressure into a delivery tubing, the delivery tubing having a nozzle that includes a plurality of nozzle jets, the nozzle adapted to increase the velocity of the mixture upon ejection therefrom, inserting the delivery tubing into the conduit, positioning the nozzle within the conduit proximate to obstructive material in the conduit, and ejecting the mixture through the nozzle against the obstructive material to loosen the obstructive material.

The method of removing obstructions may further include moving the tubing through at least a partial length of the conduit to loosen obstructive material in the at least partial length of the conduit. The method may include removing the delivery tubing from the conduit, replacing the nozzle with a second nozzle of a different type or having a different configuration than the first nozzle to improve efficiency or effectiveness depending upon the particular existing conditions.

The method may include additional elements, such as: ejecting the mixture from the nozzle to loosen the obstructive material inside the conduit without substantially damaging the conduit; ejecting the mixture from the nozzle to loosen material inside the conduit without rotating the delivery tubing and without rotating the nozzle; ejecting the mixture from the nozzle at angles of between about 80 degrees and about 100 degrees relative to the inside surface of the conduit; connecting a gauge ring to the nozzle and moving the delivery tubing through the conduit to detect the location of material within the conduit and center the nozzle assembly within the conduit.

In still another aspect of the invention, there is provided a method of separating substantially spherically shaped solid abrasive particles having a known approximate particulate size from a composite effluent that includes fluid, obstructive particles removed from a conduit and the substantially spherically shaped abrasive particles, the substantially spherically shaped solid abrasive particles having a particulate density that is generally less than the density of the obstructive particles, including removing from the composite effluent obstructive particles that are larger in particulate size than the substantially spherically shaped solid abrasive particles, removing from the composite effluent obstructive particles having a density greater than the density of the substantially spherically shaped solid abrasive particles, and separating substantially spherically shaped solid abrasive particles from the fluid. This method may also include removing gas from the composite effluent, and may also include mixing the substantially spherically shaped solid abrasive particles and the fluid to form a mixture, and pumping the mixture into a delivery tubing for removing obstructions from inside a conduit.

In another embodiment of the method of separating substantially spherically shaped solid abrasive particles, the substantially spherically shaped solid abrasive particles have a particulate density that is generally greater than the density of the obstructive particles and the fluid, the method including removing from the composite effluent obstructive particles that are larger in particulate size than the substantially spherically shaped solid abrasive particles, and removing substantially spherically shaped solid abrasive particles from the composite effluent. This embodiment may also include removing gas from the composite effluent and separating obstructive particles from the fluid.

In another embodiment of the method of separating substantially spherically shaped solid abrasive particles, the substantially spherically shaped solid abrasive particles are constructed at least partially of ferromagnetic metal, and includes removing from the composite effluent obstructive particles that are larger in particulate size than the substantially spherically shaped solid abrasive particles, and removing, from the composite effluent, substantially spherically shaped solid abrasive particles constructed at least partially of ferromagnetic metal. This embodiment may include removing gas from the composite effluent and separating obstructive particles from the fluid.

Accordingly, the present invention comprises a combination of features and advantages which enable it to substantially advance the technology associated with removing obstructions from conduits. The conduit cleaning system of the present invention includes a mixture having substantially spherically shaped solid abrasive particles (as defined herein), a mixture delivery tubing and a nozzle assembly capable of efficiently and effectively loosening and removing obstructions in the conduit. The system of the present invention is capable of loosening and removing the obstructions without causing substantial or undesirable damage to the conduit. Preferably, the system is simple, cost effective and easy to manufacture and operate. Ideally, the system could utilize existing equipment. The system does not need to be rotated and can use static seals unaffected by high temperatures. Further, the present invention also includes a system for recirculating or reusing the spherical solids and fluid from the mixture. The characteristics and advantages of the present invention described above, as well as additional features and benefits, will be readily apparent to those skilled in the art upon reading the following detailed description and referring to the accompanying drawings.

BRIEF DESCRIPTION OF THE DRAWINGS

For a detailed description of the preferred embodiments of the invention, reference will now be made to the accompanying drawings wherein:

FIG. 5 is a partial cross-sectional view of still another embodiment of a nozzle assembly of a conduit cleaning system in accordance with the present invention.

FIG. 5*a* is a front view of the nozzle assembly of FIG. 5 showing the center nozzle jets and angled nozzle jets.

FIG. 6 is a partial cross-sectional view of an embodiment of a nozzle assembly having nozzle jet inserts in accordance with the present invention.

FIG. 6*a* is a cross-sectional view of the device of FIG. 6 taken along lines 6*a*—6*a* showing the side nozzle jet insert recesses in accordance with the present invention.

FIG. 6*b* is a front view of the nozzle assembly of FIG. 6 showing the center nozzle jet insert.

FIG. 8 is a cross sectional view of the nozzle assembly of FIG. 7.

FIG. 8*a* is a cross-sectional view of the device of FIG. 8 taken along lines 8*a*—8*a* showing the second set of wide portions of the gauge ring and associated external fluid passageways in accordance with the present invention.

FIG. 8*b* is a cross-sectional view of the device of FIG. 8 taken along lines 8*b*—8*b* showing the first set of wide portions of the gauge ring and associated external fluid passageways in accordance with the present invention.

FIG. 8*c* is a cross-sectional view of the device of FIG. 8 taken along lines 8*c*—8*c* showing the side nozzle jets on the third nozzle head step in accordance with the present invention.

FIG. 8*d* is a cross-sectional view of the device of FIG. 8 taken along lines 8*d*—8*d* showing the side nozzle jets on the second nozzle head step in accordance with the present invention.

FIG. 8*e* is a cross-sectional view of the device of FIG. 8 taken along lines 8*e*—8*e* showing the side nozzle jets and angled nozzle jets on the first nozzle head step in accordance with the present invention.

FIG. 9 is an end view of the downstream end of a nozzle assembly made in accordance with the present invention shown in a conduit.

FIG. 10 is an end view of the downstream end of another embodiment of a nozzle assembly made in accordance with the present invention shown in a conduit.

FIG. 11 is a partial cross-sectional view of another embodiment of a nozzle assembly of a conduit cleaning system in accordance with the present invention.

DETAILED DESCRIPTION OF THE PREFERRED EMBODIMENTS

Figure 1:
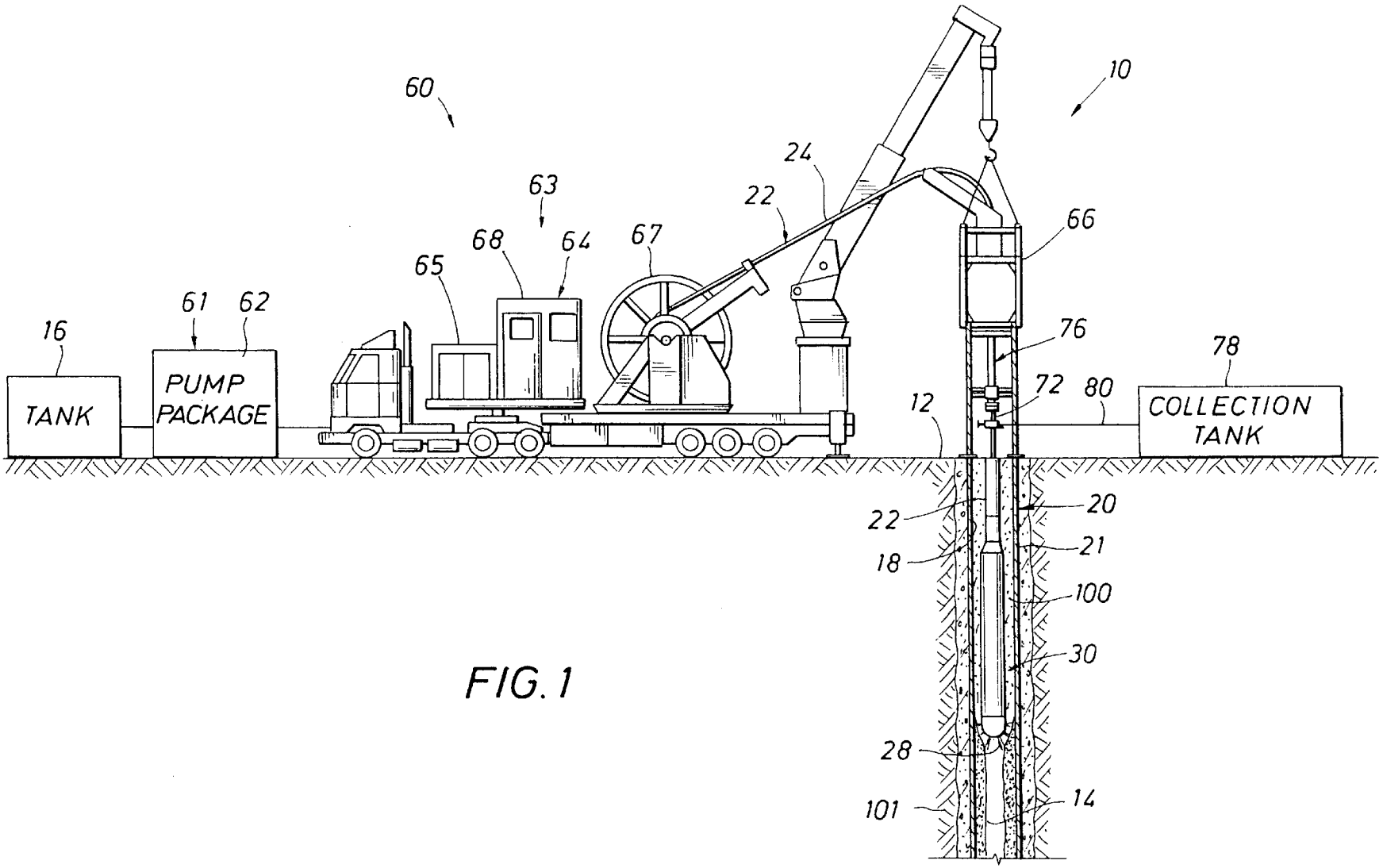
FIG. 1 is a side view of an embodiment of a conduit cleaning system and mixture delivery system shown in use in an underground petroleum well tubular in accordance with the present invention.

Presently-preferred embodiments of the invention are shown in the above identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 2:
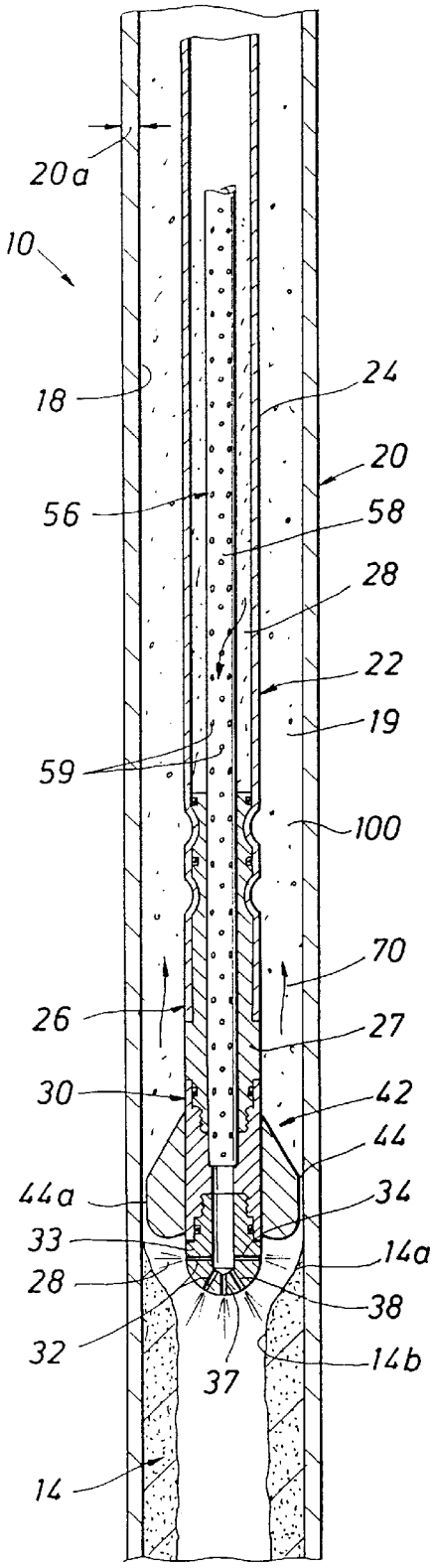
FIG. 2 is a partial cross-sectional view of an embodiment of a nozzle assembly of a conduit cleaning system in accordance with the present invention in use in a conduit.

Referring initially to FIGS. 1 and 2, a conduit cleaning system 10 of the present invention capable of loosening and removing obstructive material (obstructions) 14 built-up on the interior surface 18 of, or otherwise disposed in, a metallic conduit 20 is shown. The obstructions 14 can partially, or completely, obstruct the passage of fluids, material or equipment through the conduit 20. Many different types of obstructive material 14 may be removed with the use of the system 10, including, but not limited to, barium sulfate, strontium sulfate, calcium sulfate, calcium carbonate, iron sulfide, other scale precipitates (such as silicates, sulfates, sulfides, fluorides, carbonates), cement, corrosion products, deteriorated conduit lining, and dehydrated material (such as drilling fluid). As used herein and in the appended claims, the terms "obstructions," "obstructive material" and variations thereof mean all types of undesirable materials built-up on the interior surface of, or otherwise disposed in, a metallic conduit.

The metallic conduit 20 illustrated in FIG. 1 is an underground petroleum well tubular 21, but the conduit 20 may be any type of tubular element containing obstructive material 14 or having obstructive material 14 disposed on its interior surface 18, such as well tubing, will casing, injection lines, pipelines, flowlines, boiler tubes, heat exchangers and water lines. Further, it should be understood that the present invention is also useful in loosening and removing obstructions in components (not shown) associated with or attached to the conduit 20 and having surfaces accessible through the conduit 20, such as, but not limited to, connectors, safety valves, gas lift valves and nipples.

Still referring to FIGS. 1 and 2, the system 10 includes an obstruction removal mixture 28, a mixture carrier tubing 22 and a nozzle assembly 30. An example of tubing 22 is conventional coiled tubing 24, but the tubing 22 can take any other suitable form. Further, the tubing 22 is preferably controllably movable through the conduit 20 and allows delivery of the mixture 28 under pressure to the nozzle assembly 30, which ejects the mixture 28 against the obstructions 14.

The obstruction removal mixture 28 includes particles (not shown) that: (1) have a spherical or substantially spherical shape; (2) are constructed at least partially of solid material (the term "solid" as used herein and in the appended claims means not liquid or gaseous); and (3) are abrasive, the term "abrasive" as used herein and in the appended claims meaning capable of pulverizing, shattering, fracturing or otherwise loosening brittle material. These particles are referred to herein and in the appended claims as "spherical solids," "spherical solid particles," "substantially spherically shaped solid abrasive particles" and variations thereof Other properties of the spherical solids, such as size, density and composition, can be selected and varied as desired so long as the mixture can be used in accordance with the present invention. For example, spherical solids having densities greater or lesser than the density of the fluid or of the obstructive materials may be desirable. Examples of types of spherical solids include, but are not limited to, particles constructed partially or entirely of glass, ceramic, plastic, metal, epoxy or combinations thereof; such as glass beads, hollow glass beads, ceramic beads and metal shot. Spherical solids having various sizes, such as, for example, beads ranging from about 20 mesh to about 100 mesh, may be desirable.

The mixture 28 also includes fluid. As used herein and in the appended claims, the term "fluid" means one or more liquids, one or more gasses, foam or a combination thereof. In accordance with the present invention, the mixture 28, having fluid and spherical solid abrasive particles, is useful in the loosening and removal of obstructions 14 built up on the conduit surface 18 or otherwise inside the conduit 20. For example, a mixture 28 having a concentration of between about ⅛ and about ¾ lb of spherical glass beads, such as beads sized at between about 20 mesh and about 100 mesh, per gallon of fluid supplied through the tubing 22 at a flow rate of between about 0.50 bbl/min and about 1.50 bbl/min and ejected in accordance with the present invention may be used to effectively remove various types of obstructions from conduit 20 at rates of between about 1 ft/min and about 8 ft/min. It should be understood that the present invention is not limited to the above example formulation, and any suitable formulation of mixture 28 may be used.

The mixture 28, having spherical solids as described herein, may, if desired, be formulated to allow controlled, or minimal, erosion and damage to the conduit surface 18. For instance, the composite type, mass, particulate size, angle of impact and concentration of the spherical solids can be selected to minimize erosion or damage to the conduit surface 18. Certain composite types of spherical solids have a greater capability of causing generally more or less erosion or damage to the conduit surface 18 under similar operating conditions. Spherical solid metal or steel shot or beads, for example, generally causes greater erosion to a metallic conduit 20 as compared with glass beads under similar operating conditions. Further, the smaller the particulate size of the individual spherical solid beads or shot, generally the less the erosive effect on the conduit surface 18 under similar operating conditions in accordance with the present invention. For example, effective removal of obstructions 14 with a mixture 28 containing small glass beads, such as beads sized at between about 60 mesh and about 100 mesh, may cause a desirably smooth finish on the conduit surface 18, while a mixture 28 with a similar concentration of larger spherical glass beads, such as beads sized at between about 20 mesh and about 40 mesh, may cause minor dimpling and may create a rougher finish on the interior surface 18.

The fluid used in the mixture 28 may be any among a variety of fluids having characteristics capable of generally uniformly carrying the spherical solids through the tubing 22, such as gas, water, other liquids, foam or a combination thereof. Various fluids containing chemicals may be included in the mixture 28, such as acids or solvents designed to dissolve particular types of obstructions. For example, the mixture 28 may be a gelled fluid matrix, such as a mixture of about 1½ quarts of Xanvis L® per barrel of seawater.

Figure 3:
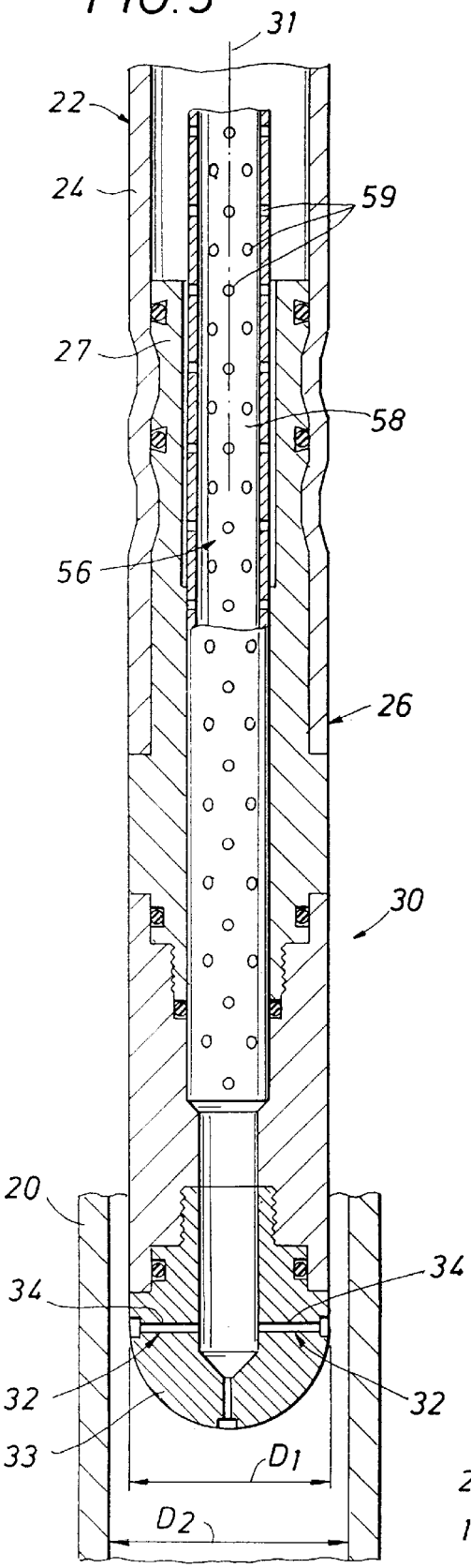
FIG. 3 is a partial cross-sectional view of another embodiment of a nozzle assembly of a conduit cleaning system in accordance with the present invention.

Now referring to FIGS. 2 and 3, the nozzle assembly 30 is preferably disposed on the end 26 of the tubing 24, such as with a crimped, or rolled, connector 27. The nozzle assembly 30 includes one or more nozzle jets 32 capable of allowing ejection of the mixture 28 at a sufficient velocity and angle against obstructive material 14 built-up on the surface 18 to bombard, pulverize, fracture, erode or otherwise loosen the obstructions 14 from the surface 18. Any desirable quantity, size, orientation and configuration of nozzle jets 32 capable of removing obstructions 14 and suitable for the system 10 may be used.

In one embodiment, such as shown in FIGS. 5 and 5*a*, the nozzle jets 32 are formed integrally into a nozzle head member 33. In another embodiment, such as shown in FIGS. 6–6*b*, the nozzle jets 32 include fabricated or commercially available jet inserts 32*a* matable with threaded recesses 32*b* in nozzle head 33. The jet inserts 32*a* may be case hardened and may be overlaid with strengthening material, such as tungsten carbide, by methods known in the art, to prevent washing out. Should a nozzle jet insert 32*a* wash or fall out of an otherwise functionable nozzle head 33, the nozzle head 33 may be reused by replacing the nozzle insert 32*a*. The nozzle head 33 may be constructed from various types of suitable materials, such as, for example, case-hardened commercial heat-treated steel. Material hardness of the nozzle head 33 can be increased with conventional strengthening treatments that are or become known in the art.

Figure 4:
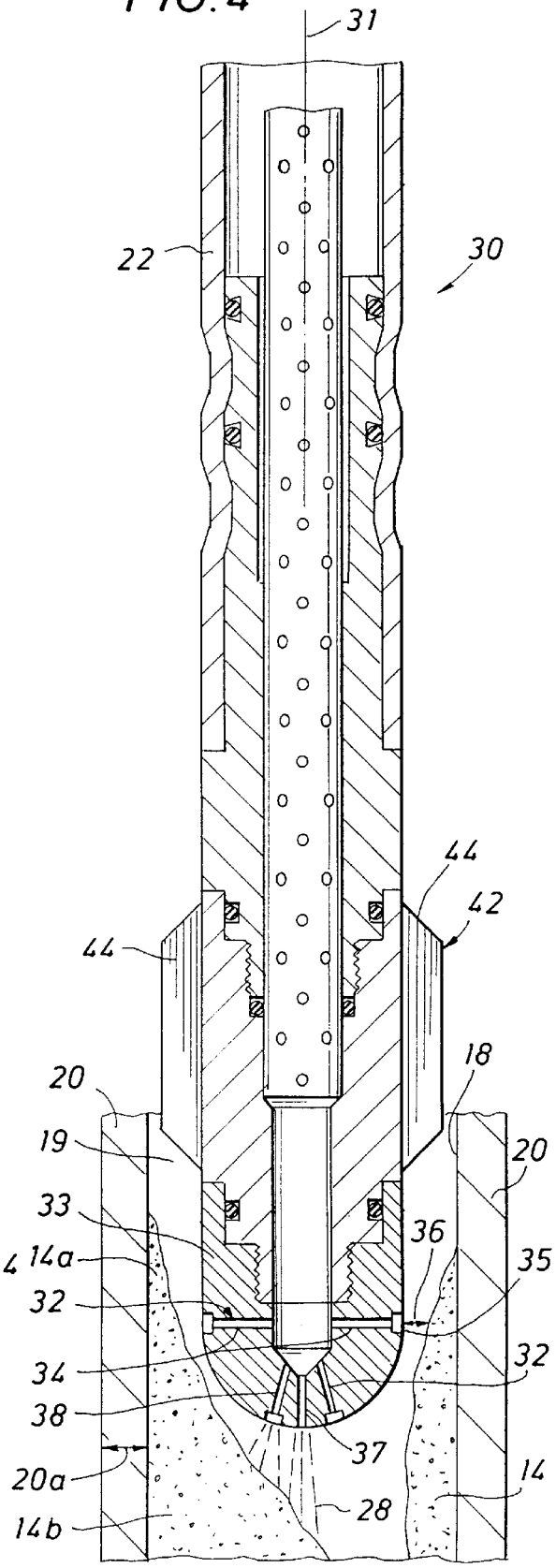
FIG. 4 is a partial cross-sectional view of yet another embodiment of a nozzle assembly of a conduit cleaning system in accordance with the present invention in use in a conduit.

Referring to FIGS. 2 and 4, the jets 32 may be arranged in the nozzle assembly 30 in any configuration suitable for effective use with the present invention. In the preferred embodiments, the assembly 30 includes numerous jets 32 capable of ejecting mixture 28 at angles of about 80–100 degrees, preferably about 90 degrees, relative to obstructions 14. Depending on various factors, such as the type and velocity of the spherical solid particles in the mixture 28 and the hardness of the conduit surface 18, this approximate 90 degree jet orientation is capable of providing various benefits. For example, damage to the surface 18 of the conduit 20 may be minimized due to the shot-peening effect of certain types of spherical solid particles in the mixture 28 as they impact the surface 18. As obstructions 14 at a particular location on the metal surface 18 are pulverized and removed, certain types of spherical solid particles (in the mixture 28), such as, for example, glass spheres, produce tiny, shallow craters in the surface 18. Subsequently ejected spherical solid particles contacting the same location on the surface 18 will strike the crater peaks, reducing their height and smoothing the surface 18, providing a generally cold worked, uniformly compressed, work hardened metal layer. As a result, the thickness 20*a* of the conduit 20 is not significantly diminished. Further, in this example, no significant erosion is caused to the surface 18, which, after use of the system 10, may be more resistant to surface stress cracking than previously. It should be understood that this example of a benefit of the approximate 90 degree jet orientation is not necessary for practice of the present invention, and there are other benefits.

The distance 36 (FIG. 4) from the orifice 35 of a nozzle jet 32 to adjacent obstructions 14 is referred to herein as the "standoff" distance. It is generally desirable to have a minimal standoff distance 36 for various reasons, such as to enable the spherical solids in the mixture 28 to contact obstructions 14 at a maximum velocity and, hence, a maximum momentum, and to optimize system energy use. In contrast, a longer standoff distance 36 of mixture 28 from jets 32 to obstructions 14 will result in decreased velocity and momentum at the obstruction 14 and require more input energy for effective cleaning because the mixture 28 decelerates upon being ejected from the nozzle assembly 30. Further, the mixture 28 is slowed by the viscous forces of fluid it must pass through in the annulus 19 between the nozzle assembly 30 and the conduit 20. In addition, the spherical solids in the mixture 28 are subject to velocity loss due to eddy formation once ejected from the nozzle assembly 30.

Effective standoff distances 36 vary depending on numerous factors, such as the composition and velocity of the mixture 28 and the diameter and quantity of nozzle jets 32. For example, the delivery of a mixture 28 carrying spherical solid glass beads sized between about 60 mesh and about 100 mesh with a density of about 160 lb/ft$^3$ and having an ejection velocity of between about 300 ft/sec to about 700 ft/sec at the orifices 35 of between five and eight jets 32 of nozzle assembly 30 is capable of removing obstructions 14 of barium sulfate scale at a standoff distance 36 of at least about 0.15 inches. It should be understood that the present invention is not limited to the examples and values above (or any of the various other examples and values described elsewhere herein), all of which are provided for illustrative purposes.

Still referring to FIGS. 2 and 4, the preferred embodiments of the present invention include numerous jets 32 that are side nozzle jets 34 disposed in the nozzle assembly 30 at angles of between approximately 80 degrees and approximately 100 degrees (preferably about 90 degrees) relative to the central axis 31 of the nozzle assembly 30. The side jets 34 are preferably capable of ejecting mixture 28 generally at angles of about 90 degrees relative to obstructions 14*a* located adjacent to the nozzle assembly 30 and jets 34. The standoff distance 36 from the jet orifices 35 of nozzle jets 34 to the adjacent obstructions 14*a* may thus be minimized.

Referring to FIGS. 2, 4, 5 and 5*a*, additional jets 32, such as jets 37 and 38, may be included in the nozzle assembly 30 to provide the capability of at least partially clearing obstructions 14*b* built-up on the conduit surface 18 forward of the nozzle assembly 30, as well as loose or packed obstruction material or debris, such as sand, silt and other detritus, (not shown) located in the conduit 20 forward of the nozzle assembly 30. These jets 37, 38, when included, may assist in clearing a path forward of the nozzle assembly 30 to allow movement of the assembly 30 in the conduit 20 and positioning of the side jets 34 adjacent to the obstructions 14. For example, a center jet 37 disposed in the approximate, or exact, center of the front of the nozzle assembly 30 is capable of ejecting mixture 28 generally at an angle of about 0° relative to the central axis 31 of the nozzle assembly 30. Mixture 28 ejected from jet 37 (FIG. 4) will contact obstructions 14*b* and other material located forward of the nozzle assembly 30. One or more angled jets 38 disposed around the center jet 37 can be oriented to eject mixture 28 at angles between about 0° and about 90°, such as about 15°, relative to the nozzle central axis 31, for impacting obstructions 14*b* located angularly forward of the nozzle assembly 30. Thus, one or more jets 32 may be positioned in different locations on the nozzle assembly 30 to form one or more "planes of obstruction contact" for removal of obstructions 14 and other debris at different locations in the conduit 20. In FIGS. 5, 5*a*, for example, side jets 34 form a first (primary) plane of obstruction contact around the circumference of the nozzle head 33, center jet 37 provides a second plane of contact, and angled jets 38 create a third simultaneous plane of contact.

Referring to FIG. 3, the outer nozzle diameter $D_1$ of the nozzle assembly 30 is dictated by various factors, such as, but not limited to, the inner diameter $D_2$ of the conduit 20, the thickness of the obstructions therein (not shown) and the pumping capability of the system pumping equipment. It may also be desirable or effective to use several nozzle assemblies 30 successively to clean a particular conduit 20. For example, a nozzle assembly 30 having a small outer nozzle diameter $D_1$, such as approximately equal to the outer diameter of the carrier tubing 24 (FIG. 3), may be used initially to open a "pilot passage" through the obstructions 14 in the conduit 20. Thereafter, one or more other nozzle assemblies 30, each having a successively larger outer nozzle diameter $D_1$, may be used for removing the obstructions 14 from conduit 20.

Figure 7:
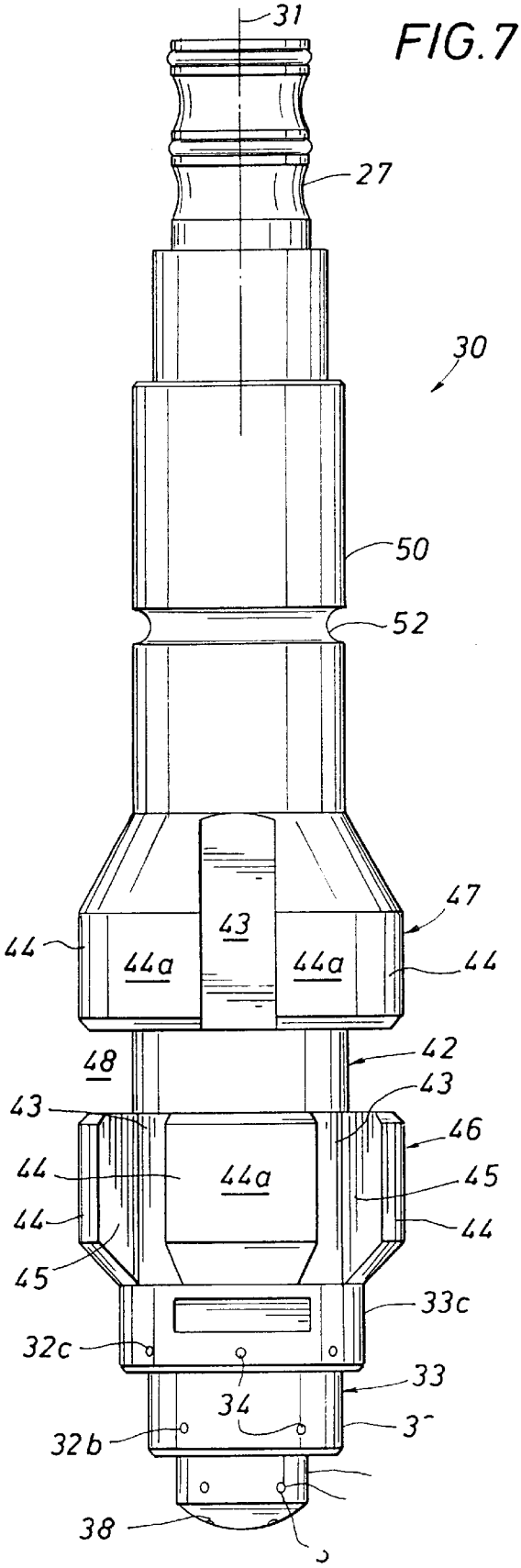
FIG. 7 is a side view of another embodiment of a nozzle assembly made in accordance with the present invention.

Furthermore, a single nozzle assembly 30 may be configured with nozzle jets 32 located at different nozzle diameters, such as, for example, in the embodiment shown in FIGS. 7 and 8. Nozzle head 33 has steps 33*a,* 33*b* and 33*c* of corresponding diameters $d_1$, $d_2$, and $d_3$ and which carry jets 32*a,* 32*b* and 32*c,* respectively. The nozzle head 33 is shown also including angled jets 38. This assembly 30 may be useful to clear a pilot hole through the obstructions in the conduit (not shown) and also removing successive layers of obstructions (not shown). It should be understood, however, that the use of numerous nozzle assemblies 30 or a nozzle assembly 30 with jets 32 at different nozzle diameters is not necessary for the present invention.

Referring again to FIGS. 3 and 4, any suitable quantity of jets 32 can be used. The desired quantity of jets 32 can be determined based on various factors, such as but not limited to, the number of planes of obstruction contact on the assembly 30, the outer nozzle diameter $D_1$, the conduit inner diameter $D_2$, the composition of the mixture 28 and the thickness and composition of the obstructions 14. Nozzle assemblies 30 with large outer nozzle diameters $D_1$ may require additional jets 32 to effectively remove obstructions 14 from the entire conduit surface 18. For example, a nozzle assembly 30 with an outer diameter $D_1$ of between about 1.00 inches and about 1.25 inches and having five to six side jets 34 may be capable of sufficiently cleaning a conduit 20 having an inner conduit diameter $D_2$ of between about 2.5 inches and 2.8 inches, while a nozzle assembly 30 having an outer diameter $D_1$ of between about 2.0 inches and 2.5 inches and ten side jets 34 may be necessary for effectively cleaning a conduit 20 having an inner diameter $D_2$ of between about 3.0 inches and about 3.5 inches. Another factor that may be desirable for consideration is that the greater the quantity of jets 32 contributing to a particular plane of obstruction contact, such as jets 34 of FIG. 3, the smaller the size of the removed particles of obstruction. For example, the configuration of nozzle 30 in FIG. 9, having four side jets 34 spaced evenly around the circumference of the nozzle head 33, will create larger sized removed particles of obstruction than the configuration of FIG. 10 having ten side jets 34 (for the same composition mixture 28 and type of obstruction 14).

The size and quantity of jets 32 in the nozzle assembly 30 may be selected to provide a particular ejection, or contact, velocity or velocity range of the mixture 28 at a given supply flow rate into the nozzle assembly 30. The velocity (V) of the mixture 28 at each jet orifice 35 equals the total flow rate ($Q_t$) of the mixture 28 through the jets 32 divided by the combined cross-sectional areas ($A_t$) of all jet orifices 35 ($V=Q_t/A_t$). Generally, the greater the quantity of jets 32 ejecting the mixture 28, the lower the ejection, or contact, velocity at the same supply flow rate into the carrier tubing 22. For example, a flow rate of about 0.75 bbl/min. of mixture 28 through a nozzle assembly 30 with seven jets 32 each having a diameter of about 0.063 inches may be capable of achieving ejection velocities of between about 500 ft/sec.

Now referring to FIGS. 4 and 11, the nozzle assembly 30 may be equipped with a gauge ring, or mandrel, 42 preferably located on the nozzle assembly 30 between the jets 32 and the carrier tubing 22. The gauge ring 42 may have any construction and configuration suitable for use with the present invention. Preferably, the gauge ring 42 includes at least one wide portion 44 that extends radially from the nozzle assembly 30 and one or more external fluid passageways 43 (FIG. 7). The "external" fluid passageways 43 are external to the nozzle assembly 30, allowing the flow of fluid along the outside of the nozzle assembly 30. The gauge ring 42 preferably has capabilities which include one or more of the following: generally guiding the carrier tubing 22 and nozzle assembly 30 through the conduit 20; centering the nozzle assembly 30 within the conduit 20; providing outer mandrel bearing surfaces 44*a* (FIG. 7) for bearing forces placed on the nozzle assembly 30 from contact with the conduit surface 18 (FIG. 2); detecting the presence and location of obstructions on the conduit surface 18 (FIG. 2); and allowing a fluid return flow path through the annulus 19 (FIG. 2) to the surface (not shown) for the ejected mixture 28 and removed obstructions.

The nozzle assembly 20 may be configured with two mandrels (not shown) or a mandrel 42 having numerous sets of wide portions 44, such as shown, for example, in FIGS. 7 and FIGS. 8, 8*a* and 8*b*. In the illustrated embodiment, a first set 46 of wide portions 44 is shown offset, such as by 45 degrees, relative to a second set 47 of wide portions 44. A space 48 is formed between the sets 46, 47 of wide portions 44. The gauge ring 42 is "fluted", the flutes 45 forming the fluid passageways 43. Adjacent flutes 45 of the same set of wide portions 46 or 47 are shown spaced apart 90 degrees from one another relative to the nozzle assembly central axis 31. This type of configuration is capable of providing 360 degrees of combined outer mandrel bearing surface 44*a* around the nozzle assembly 30, while allowing a "return flow path" through fluid passageways 43 and space 48.

The gauge ring 42 may be equipped with a fishing neck 50 capable of being connected with or gripped, such as at recess, or groove, 52 (FIGS. 7 and 8), by a conventional fishing tool (not shown) for recovery of the nozzle assembly 30 should the assembly 30 disconnect from the carrier tubing 22 in the conduit 20.

A filter 56, such as shown in FIGS. 2 and 3, may be included in the system 10 for various purposes, such as to regulate the size of the spherical solids in the mixture 28 being ejected from the nozzle assembly 30 and to prevent plugging of the jets 32. Any suitable filter 56 capable of use with the present invention may be used. In the embodiments of FIGS. 2 and 3, the filter 56 is disposed within the carrier tubing 22 and nozzle assembly 30. The illustrated filter 56 includes a perforated mesh 58 having a plurality of flow holes 59 of predetermined sizes, or diameters. To prevent plugging of the nozzle jets 32, the diameter of the flow holes 59 must be equal to or smaller than the diameter of the nozzle jets 32. The mixture 28 flows into the filter 56 from the tubing 22, such that spherical solids and any other solid materials in the mixture 28 or tubing 22 that are larger than the flow holes 59 will enter neither the filter 56 nor the nozzle assembly 30. Thus, undesirably large spherical solids or other material will remain in the tubing 22 outside of the filter 56, assisting in preventing both the filter 38 and nozzle assembly 30 from becoming clogged thereby. The inclusion of a filter 56, however, is not essential for the present invention.

In another aspect of the invention, a mixture delivery system 60 will now be described. Referring to the exemplary embodiment of FIG. 1, the delivery system 60 includes a mixing tank 16 for mixing spherical solids and fluid, such as a conventionally available tank. In some instances, an in-line mixer (not shown) such as, for example, KENICS Static Mixer Model 1.75-KMA-2, may be used for mixing spherical solids and fluid, although not necessary for the present invention. The system 60 also includes a pump package 61, such as, for example, the Gardner-Denver Model PAH fluid pump, and a tubing insertion mechanism 63 capable of moving the tubing 22 into, within and from the conduit 20, such as, for example, a conventional truck-mounted coiled tubing control unit 64, which is shown including a power pack 65, tubing injector 66, hydraulically actuated coiled tubing reel 67 and control console 68. It should be understood that the present invention is not limited to these specific types of tank 16, pump package 61 and tubing insertion mechanism 63.

Referring now to FIGS. 1 and 2, a method for delivering mixture 28 with the mixture delivery system 60 to the conduit cleaning system 10 will now be described. The spherical solids are mixed and entrained in the desired fluid medium by any suitable technique. Some examples of suitable techniques include bulk mixing on-the-fly, metering, and batch mixing. Mixing on-the-fly may include dumping a metered volume of spherical solids into a fluid stream via an in-line mixer (not shown) as described above, a jet mixer (not shown), or other conventional device, prior to pumping the mixture 28 into the tubing 22 for obstruction removal. Metering involves mixing measured amounts of spherical solids into a flow stream of desired fluid and recirculating the mixture 28 into tank 16 to measure the exact composition of the mixture 28 prior to pumping. In batch mixing, a measured volume of fluid is mixed with a measured volume of spherical solids in tank 16. The mixture 28 is agitated thoroughly prior to commencing pumping and is further agitated during obstruction removal. Additional batches of the mixture 28 can be prepared while one batch is being pumped.

A suitable pump package 61, such as fluid pump 62, is used to pump the mixture 28 through the tubing 22 at a sufficient flow rate for effective obstruction removal. Generally, if the flow rate of the mixture 28 through the tubing 22 is within a range that does not exceed the pressure rating of the tubing 22, the flow of spherical solids through the tubing will not significantly erode or damage the tubing 22, such as commercially available coiled tubing 24.

A method for loosening and removing obstructions from inside a conduit 20 with the use of the conduit cleaning system 10 will now be described. The tubing 22 is inserted into the conduit 20 to position the nozzle assembly 30 at a desired location in the conduit 20 for obstruction removal. Preferably, the tubing 22 is controllably movable within the conduit 20 or within a desired portion or portions of the conduit 20 to allow the controlled removal of obstructions 14 therefrom. Any suitable conventional mechanism or technique may be used for moving the tubing 22 into, within and from the conduit 20. In the embodiment shown in FIG. 1, for example, an operator (not shown) controls the rate of injection and movement of the tubing 22 in the conduit 20 with the conventional truck-mounted coiled tubing control unit 64.

S The mixture 28 pumped into the tubing 22 is ejected from the nozzle assembly 30 through the jets 32 at a velocity such that the force of the mixture upon the obstructions 14 will pulverize, fracture, erode or otherwise loosen the obstructions 14 from the conduit 20 preferably with minimal erosion or damage to the conduit surface 18. A gauge ring, or mandrel, 42, when included on the nozzle assembly 30, such as shown in FIG. 2, may be used to assist in locating obstructions 14, positioning the nozzle assembly 30 for obstruction removal, guiding the nozzle assembly 30 through the conduit 20, determining when obstructions 14 have been removed, and other possible functions as described above. Further, wide portions 44 of the mandrel 42 may be positioned on the nozzle assembly 30 substantially adjacent to certain jets 32, such as side jets 34, allowing timely positioning of such jets 32 adjacent to obstructions 14 encountered by the wide portions 44 for obstruction removal.

The obstruction removal rate may be affected by a multitude of factors, including, but not limited to, the composite type, mass, size and concentration of the spherical solids in the mixture 28, the nozzle jet 32 configuration, and the frequency and intensity of impact by the spherical solids in the mixture 28 upon the obstructions 14. It should be understood, however, that the present invention is not limited to any particular combination, or combinations, of any such variables, but encompasses all combinations suitable for use with the present invention. For example, the obstruction removal rate generally increases as the mass of the spherical solids in the mixture 28 increases, under otherwise constant conditions. The mass of the spherical solids in the mixture 28 may be selectively increased, such as by increasing the concentration of the spherical solids in the mixture 28, or by increasing the particle size of the spherical solids, or a combination of both. Removed obstruction particle size may be important for various reasons, such as when targeting particular types of obstructions 14 for chemical reactivity where it may be desirable to have small sized removed particles, or to improve transport capabilities of removed obstruction particles.

Still referring to FIGS. 1 and 2, as the obstructions 14 are removed from the conduit surface 18, the ejected mixture 28 and removed obstruction particles, referred to collectively herein as the "composite effluent 100" are preferably circulated, as shown with flow arrows 70 in FIG. 2, out of the conduit 20 through the annulus 19 formed between the tubing 22 and the conduit surface 18. The ejected mixture 28 alone, or with a suitable additional fluid, may serve as the return fluid for carrying, or forcing, the removed obstruction particles up the conduit 20 to the surface 12. It should be noted that the size of removed obstruction particles may affect their rate of evacuation. For example, large removed particles generally require a greater velocity and/or viscosity of the return fluid in the annulus 19 for moving the removed obstruction particles to the surface 12.

The composite effluent 100 may be collected and disposed of in any suitable manner. In the embodiment of FIG. 1, for example, the composite effluent 100 exits the conduit 20 through an outlet 72. A stripper assembly 76 seals around the tubing 22 and directs the composite effluent 100 to a collection tank 78 via line 80, which is connected to the outlet 72.

Figure 12:
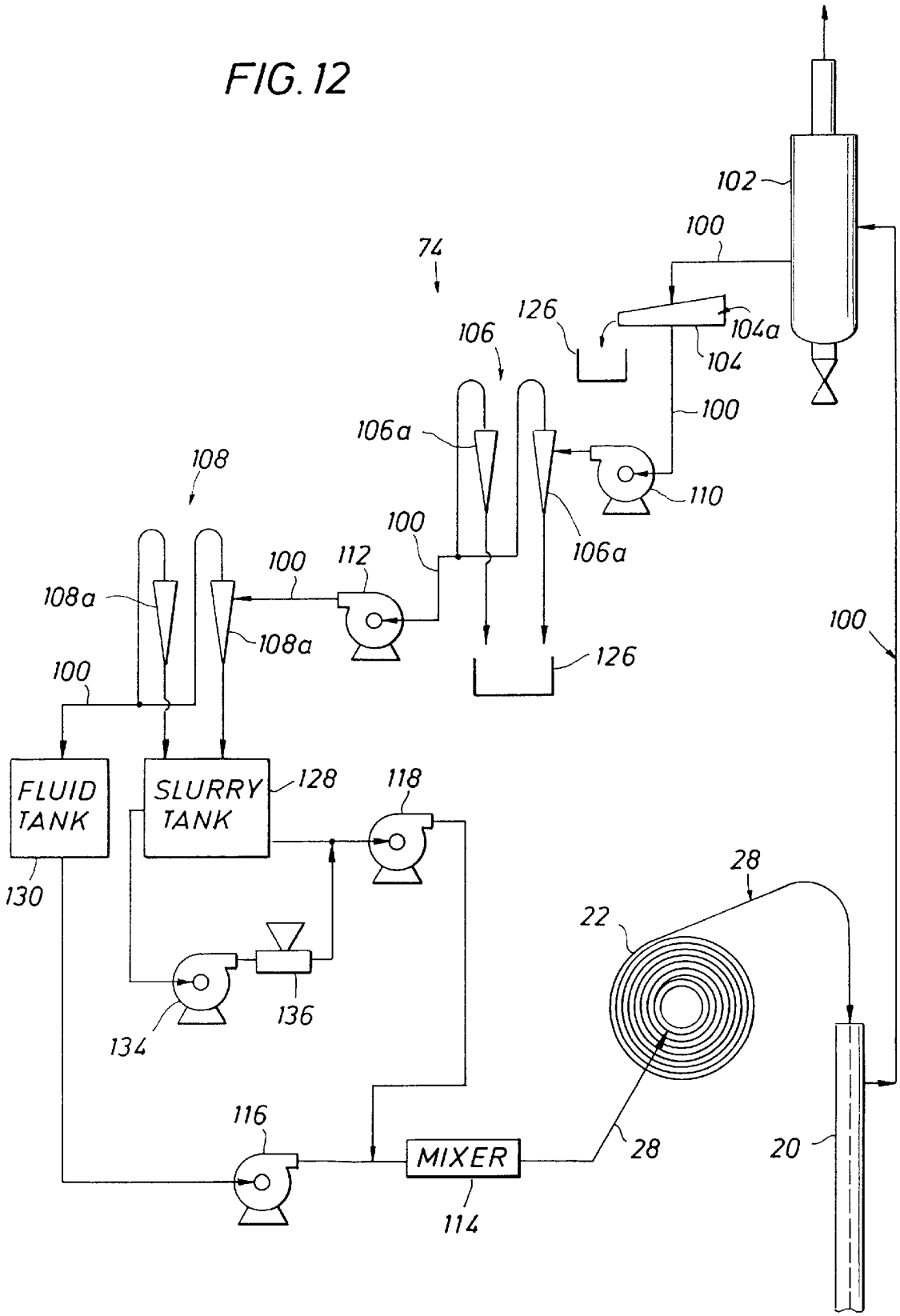
FIG. 12 is a schematic view of am embodiment of a separation/return system made in accordance with the present invention.

The spherical solids and fluid in the composite effluent 100 may be separated and reused in the obstruction removal process with the use of any suitable separation/return system 74. An example of a separation/return system 74 is illustrated in FIG. 12. This system 74 includes a size-differentiating particle separator 104 being capable of separating out large obstruction particles from the composite effluent 100, such as, for example, a conventional shale shaker 104*a* having a screen, or mesh. The system 74 also includes a small particle separator 106 capable of separating out either small obstruction particles or spherical solids from the composite effluent 100. Examples of separators 106 include, but are not limited to, a set of conventional hydrocyclones 106*a,* or a conventional centrifuge (not shown), or a conventional magnetic separator (not shown). To separate out the fluid from the effluent 100 for reuse, the system also includes a fluid/particle separator 108 capable of separating out small sized particles from fluid of the composite effluent 100, such as, but not limited to, a set of conventional hydrocyclones 108*a* or a conventional centrifuge (not shown). The system also includes composite effluent pumps 110, 112 capable of pumping the composite effluent 100 within the system 74, such as, but not limited to, conventional centrifugal pumps.

Also included in the system 74 may be a gas separator 102 capable of separating out and venting gas from the composite effluent 100, such as a mud-gas separator or "poorboy" degasser of conventional oil field design; a conventional in-line mixer 114 capable of mixing spherical solid particles with fluid to form mixture 28, such as Kenics Static Mixer Model 1.75-KMA-2; a fluid pump 116 capable of pumping fluid to the mixer 114, such as a triplex well servicing pump; and a slurry pump 118 capable of pumping spherical solid particles into a fluid stream, such as an SQ Special unit having a Binks 41-14900 hydraulic motor and Graco King® 56:1 fluid section.

An exemplary method of separating used spherical solid particles from a composite effluent 100 in accordance with the present invention will now be described. Referring to FIG. 1, the composite effluent 100 may be passed through a choke manifold (not shown) for one or more purposes, such as, for example, to reduce pressure on the composite effluent stream directed into the separation/return system 74. Another purpose may be to maintain "backpressure" on the well during use of the present invention to prevent excessive gas or oil influx into the well casing 21 from the formation 101. The backpressure can be adjusted by opening or closing the choke manifold (not shown) to ensure that the conduit cleaning system 10 and the separation/return system 74 are maintained in a steady-state condition, neither gaining fluids from nor losing them to the formation 101. It should be understood that passing the composite effluent 100 through a choke manifold is not necessary for practice of the present invention.

Now referring to FIG. 12, the composite effluent 100 may be passed, such as through hard piping (not shown), to a gas separator 102 where any gas in the composite effluent 100 is removed from the effluent 100. The gas may be vented to the atmosphere, flared or recovered for compression and sale or otherwise collected for disposal. Hazardous quantities of any toxic gas constituents, such as hydrogen sulfide and carbon dioxide, may be removed from the normal breathing zone for workers. Installation of a mist extractor (not shown) in this gas separator 102, though not necessary for the present invention, can be included to prevent harmful mists and aerosols from entering the atmosphere.

The composite effluent 100 is passed through a size-differentiating particle separator 104 that separates large particles of obstruction 14 and any other large debris in the composite effluent 100 that are larger than the particulate size of the spherical solids in the effluent 100. Particles separated by separator 104 may include large particles of removed obstruction 14, rust from the conduit 20 or from various equipment, formation particles and agglomerations of smaller particles. In the preferred embodiment, the effluent is piped to a shale shaker 104*a* having a screen, or mesh, (not shown) with passage holes sized to allow the passage therethrough of fluid, the spherical solids and other particles equal in size or smaller than the spherical solids. The fluid, spherical solids and other such small particles pass through the separator 104 and are collected, such as in a holding tank (not shown). The holding tank, if used, can be equipped with an agitator (not shown) to keep particles in suspension pending their subsequent removal from the fluid. Particles having a particulate size greater than the screen or mesh holes are collected, such as in a particle, or cuttings, bin 126 for subsequent disposal.

The spherical solids are thereafter separated from the remaining particles of removed obstruction 14 and any other debris in the effluent 100 with the use of a small particle separator 106. This can be achieved in various ways. For example, a centrifuge (not shown) or set of hydrocyclones 106*a* could be used to separate the particles based on particle density. The configuration of FIG. 12 having hydrocyclones 106*a* is useful when the spherical solids possess a density that is generally smaller than the density of the particles of obstruction 14 and fluid in the effluent 100, such as, for example effluent 100 having glass bead spherical solids and obstruction particles of common barium sulfate. In the embodiment of FIG. 12, the effluent 100 is passed through a set of hydrocyclones 106*a* designed to provide density separation. The heavier (more dense) obstruction, or waste, particles are removed from the lighter spherical solids/fluid mixture. These obstruction particles may be collected in a particle bin 126, passed through a fluid/particle separator (not shown), such as a shale shaker similar to shale shaker 104*a* for remaining fluid removal, or otherwise disposed of. The remaining effluent 100 (primarily or exclusively fluid and spherical solids) is piped to a fluid/particle separator 108 capable of separating the spherical solids from the fluid. In the example of FIG. 12, a set of small diameter, high efficiency hydrocyclones 108*a* is used to separate all remaining particles from the fluid.

If, however, the spherical solids are more dense than the removed particles of obstruction 14, the small particle separator 106 can also be a density-differentiating particle separator, such as hydrocyclones 106*a* described above. In this instance, the more dense spherical solids are separated from the lighter obstruction particles/fluid mixture and may be collected for reuse, such as in a slurry tank similar to tank 128 shown in FIG. 12. The remaining effluent 100, including fluid and obstruction, or waste, particles, can be collected and disposed of, or piped to a fluid/particle separator 108, or hydrocyclones 108*a,* for separating all remaining particles from the fluid.

Operating conditions can be adjusted to optimize small solids separation with the use of hydrocyclones 106*a,* a centrifuge (not shown) or a similar small particle separator 106. Numerous variables, such as hydrocyclone 106*a* diameter, the number of hydrocyclones 106*a,* pump rate and pressure into the hydrocyclone(s) 106*a,* or centrifuge speed, can be adjusted to achieve the desired separation. For example, energy to operate hydrocyclones 106*a* can be provided with a conventional pump (not shown). Pump pressure can be adjusted with the use of a valve (not shown) at the inlet of the separator 106*a*. Variable speed motors can be used to change hydrocyclone pump rate or centrifuge speed.

The spherical solids may instead be separated from the small removed obstruction particles and other debris in the composite effluent 100 based on other particle properties, such as ferromagnetic attraction, electrostatic activity or particle chemistry. For example, spherical solids constructed at least partially of ferromagnetic metal, such as steel shot, can be separated using a small particle separator 106 that is a conventional rotating magnetic separator (not shown).

Similarly as the method described above, the more dense spherical solids are separated from the lighter obstruction particles/fluid mixture and may be collected for reuse, such as in a slurry tank similar to tank 128 shown in FIG. 12. The remaining effluent 100, including fluid and obstruction, or waste, particles, can be collected and disposed of, or piped to a fluid/particle separator 108, or hydrocyclones 108*a,* for separating all remaining particles from the fluid.

In all cases, the separated spherical solid particles may be collected in a slurry tank 128 for reconditioning, reuse or disposal. Additional spherical solids can be added to the slurry tank 128. If the fluid is also separated from the composite effluent 100 as described above (the fluid may include chemicals that are more expensive than the spherical solids), the fluid may be collected in a fluid tank 130 for reconditioning, reuse or disposal. The tank 130 may be an agitated tank where rheology can be adjusted to ensure optimum properties.

Still referring to FIG. 12, an exemplary method for reuse of used, recovered spherical solids in accordance with the present invention will now be described. Fluid for forming mixture 28 is pumped from the fluid tank 130 or another fluid source (not shown) to in-line mixer 114 through the fluid pump 116. The recovered spherical solids are pumped from slurry tank 128 through the slurry pump 118 into the fluid stream entering the mixer 114. The fluids and spherical solids are mixed in the in-line mixer 114 to form the mixture 28. The mixture 28 is then pumped into the carrier tubing 22. Additional spherical solids may be added to the mixture 28, such as when the recovered spherical solids are worn or when a greater concentration of spherical solids is desired in the mixture 28. For example, prior to pumping the recovered spherical solids in the fluid stream entering the mixer 114, the spherical solid slurry may be pumped, such as with the use of a pump 134 similar to the composite effluent pumps 110, 112 described above, from the slurry tank 128 through a conventional hopper/jet mixer 136, where additional spherical solids may be added to the spherical solid slurry.

While preferred embodiments of this invention have been shown and described, modifications thereof can be made by one of ordinary skill in the art without departing from the spirit or teachings of this invention. The embodiments described and illustrated herein are exemplary only and are not limiting. Many variations and modifications of the systems and methods of the present invention are possible and are within the scope of the invention. Further, the systems and methods of the present invention offer advantages over the prior art that have not been addressed herein but are, or will become, apparent from the description herein, such as, but not limited to: the present invention is easy to manufacture and operate and does not have complex component parts; the conduit cleaning system 10 is not affected by high temperature and has no requirement for rotating components; and the result of the system 10 causing little or no damage to the conduit 20 from the mixture 28 impacting the conduit 20, from reactive torque or from contact between the system 10 and the conduit. Accordingly, the scope of the invention is not limited to the embodiments described herein.

What is claimed is:

1. A system capable of removing scale deposits from an interior metallic surface of a conduit, comprising:

a mixture including a plurality of substantially spherically shaped solid particles and fluid, a mixture delivery tubing insertable into the conduit, and a nozzle attached to said mixture delivery tubing, said nozzle including a plurality of nozzle jets and being capable of ejecting said mixture to loosen scale deposits from the interior metallic surface of the conduit.

2. The system of claim 1 wherein said substantially spherically shaped solid particles are constructed at least partially of glass.

3. The system of claim 1 wherein said substantially spherically shaped solid particles are constructed at least partially of metal.

4. The system of claim 1 wherein said substantially spherically shaped solid particles are constructed at least partially of plastic.

5. The system of claim 1 wherein said substantially spherically shaped solid particles are constructed at least partially of ceramic.

6. The system of claim 1 wherein said substantially spherically shaped solid particles are constructed at least partially of epoxy.

7. The system of claim 1 wherein the size of said substantially spherically shaped solid particles is between about 20 mesh and about 100 mesh.

8. The system of claim 1 wherein the particulate density of said substantially spherically shaped solid particles is greater than the density of said fluid.

9. The system of claim 1 wherein the particulate density of said substantially spherically shaped solid particles is less than the density of said fluid.

10. The system of claim 1 wherein said nozzle is capable of ejecting said mixture to loosen scale deposits from the interior metallic surface of the conduit without substantially damaging the conduit.

11. The system of claim 1 wherein said nozzle is capable of ejecting said mixture around the inner circumference of the conduit without rotating the nozzle.

12. The system of claim 10 further including a filter capable of preventing clogging of said nozzle jets by particles carried in said mixture.

13. The system of claim 10 further including a mixer capable of mixing said substantially spherically shaped solid particles and said fluid to form said mixture, and a pump capable of pumping said mixture under pressure into said mixture delivery tubing.

14. The system of claim 1, wherein said nozzle has a central axis and wherein at least two of said plurality of nozzle jets are disposed at angles of between approximately 80 degrees and approximately 100 degrees relative to the central axis of said nozzle.

15. The system of claim 14 wherein at least one of said nozzle jets is disposed at an angle of approximately 0 degrees relative to the central axis of said nozzle.

16. The system of claim 10 wherein said nozzle is capable of ejecting said mixture to generally contact scale deposits at an angle of between approximately 80 and approximately 100 degrees relative to the scale deposits.

17. The system of claim 1 further including a gauge tool connectable to said mixture delivery tubing proximate to at least one of said at least one nozzle jets, said gauge tool having a front end and a rear end and being capable of detecting scale deposits within the conduit, whereby at least one of said at least one nozzle jets is positionable proximate to the scale deposits detected by said gauge tool.

18. The system of claim 17 wherein said gauge tool includes a plurality of outer surfaces positionable proximate to the interior metallic surface of the conduit when said gauge tool is disposed within the conduit, whereby at least one of said plurality of outer surfaces of said gauge tool is positionable adjacent to every point on the inner circumference of the conduit, said gauge tool further including at least one fluid passageway capable of allowing the flow of said mixture from the front end to the rear end of said gauge tool when said gauge tool is disposed within the conduit, said at least one fluid passageway being at least partially non-linear.

19. The system of claim 17 wherein said gauge tool includes a plurality of wide portions, each said wide portion having an outer bearing surface, said plurality of outer bearing surfaces extending around the entire circumference of said gauge tool, said wide portions forming a plurality of fluid passages capable of allowing the flow of said mixture from the front end to the rear end of said gauge tool, each of said plurality of fluid passages being in fluid communication with at least one other of said plurality of fluid passages, and each of said plurality of fluid passages being offset from at least one of said plurality of fluid passages with which said fluid passage is in fluid communication.

20. The system of claim 17 wherein said gauge tool is connected with said nozzle.

21. The system of claim 10 wherein the conduit is an underground oilfield tubular.

22. The system of claim 1, further including an apparatus for substantially separating said spherically shaped solid particles from a composite effluent that includes fluid, obstructive particles from the conduit and said substantially spherically shaped particles, the apparatus system including a size-differentiating particle separator capable of generally removing obstructive particles from the composite effluent that are generally larger in particulate size than said substantially spherically shaped solid particles.

23. The system of claim 22, further including a first density-differentiating particle separator capable of generally removing obstructive particles from the composite effluent having a density generally greater than the density of said substantially spherically shaped solid particles, and a second density-differentiating particle separator capable of generally removing said substantially spherically shaped solid particles from the fluid.

24. The system of claim 22 further including a first density-differentiating particle separator capable of generally removing said substantially spherically shaped solid particles from the composite effluent, and a second density-differentiating particle separator capable of generally removing the obstructive particles from the fluid.

25. The system of claim 22 further including a magnetic separator capable of generally removing said substantially spherically shaped solid particles constructed at least partially of ferromagnetic metal from the composite effluent.

26. A method of removing scale deposits from an interior metallic surface of a conduit, comprising:

forming a mixture including fluid and substantially spherically shaped solid particles, supplying the mixture under pressure into a delivery tubing, the delivery tubing having a nozzle that includes a plurality of nozzle jets, the nozzle adapted to increase the velocity of the mixture upon ejection therefrom, inserting the delivery tubing into the conduit, positioning the nozzle within the conduit proximate to the scale deposits in the conduit, and ejecting the mixture through the nozzle against the scale deposits to loosen the scale deposits from the interior metallic surface of the conduit.

27. The method of claim 26 further comprising moving the tubing through at least a partial length of the conduit to loosen the scale deposits in the at least partial length of the conduit.

28. The method of claim 26 further comprising removing the delivery tubing from the conduit, replacing the nozzle with a second nozzle having different performance characteristics than the first nozzle, and inserting the delivery tubing into the conduit for loosening the scale deposits in the conduit.

29. The method of claim 27 further including ejecting the mixture from the nozzle to loosen the scale deposits inside the conduit without substantially damaging the conduit.

30. The method of claim 26 further including ejecting the mixture from the nozzle to loosen the scale deposits inside the conduit without rotating the delivery tubing and without rotating the nozzle.

31. The method of claim 29 further including ejecting the mixture from the nozzle at angles of between about 80 degrees and about 100 degrees relative to the interior metallic surface of the conduit.

32. The method of claim 29 further including engaging a gauge tool with the delivery tubing and moving the delivery tubing through the conduit to detect the location of scale deposits within the conduit.

33. An apparatus capable of removing scale deposits from an interior metallic surface of a conduit, the conduit disposed at least partially underground, the apparatus comprising:

a mixture including a plurality of substantially spherically shaped solid particles and fluid, means for delivering said mixture into the conduit, and means for ejecting said mixture against the scale deposits in the conduit to loosen the scale deposits from the interior metallic surface of the conduit without substantially damaging the interior metallic surface.

34. The apparatus of claim 33, wherein said means for ejecting said mixture against the scale deposits in the conduit includes a nozzle having a central axis and at least two nozzle jets.

35. The apparatus of claim 34 wherein said nozzle is capable of ejecting said mixture to generally contact scale deposits at an angle of between approximately 80 and approximately 100 degrees relative to the scale deposits.

36. The apparatus of claim 34 wherein said nozzle is a non-rotating nozzle.

37. The apparatus of claim 34 wherein said means for delivering said mixture into the conduit includes a gauge tool disposed proximate to at least one of said nozzle jets, said gauge tool capable of detecting scale deposits within the conduit.

38. The apparatus of claim 33 wherein said means for ejecting said mixture against the scale deposits includes a gauge tool having a plurality of outer surfaces positionable proximate to the interior metallic surface of the conduit when said gauge tool is disposed within the conduit, whereby at least one of said plurality of outer surfaces of said gauge tool is positionable adjacent to every point on the inner circumference of the conduit, said gauge tool further including at least one fluid passageway capable of allowing the flow of said mixture by said gauge tool when said gauge tool is disposed within the conduit, said at least one fluid passageway being at least partially non-linear.

* * * * *